United States Patent [19]

Megerlin

[11] 4,090,559

[45] May 23, 1978

[54] HEAT TRANSFER DEVICE

[75] Inventor: Ferdi E. Megerlin, Grosswallstadt, Germany

[73] Assignee: The United States of America as represented by the Secretary of the Navy, Washington, D.C.

[21] Appl. No.: 497,549

[22] Filed: Aug. 14, 1974

[51] Int. Cl.[2] ..... F28F 1/40

[52] U.S. Cl. ..... 165/179; 138/38

[58] Field of Search ..... 165/179, 184.5; 138/38–42

[56] References Cited

U.S. PATENT DOCUMENTS

| | | | |
|---|---|---|---|
| 2,310,970 | 2/1943 | Limbert | 165/184 X |
| 2,453,448 | 11/1948 | McTurk | 165/184 |
| 2,553,142 | 5/1951 | McCreary | 165/184 X |
| 3,935,715 | 2/1976 | Newton | 165/174 X |

FOREIGN PATENT DOCUMENTS

| | | | |
|---|---|---|---|
| 417,668 | 10/1934 | United Kingdom | 165/184 |
| 234,432 | 5/1969 | U.S.S.R. | 165/184 |

*Primary Examiner*—Charles J. Myhre
*Assistant Examiner*—T. W. Streule
*Attorney, Agent, or Firm*—R. S. Sciascia; Henry Hansen

[57] ABSTRACT

A heat transfer device comprising a spiral brush insert within a tube of thermally conductive material. The brush insert has a diameter slightly larger than the inside diameter of the tube and is inserted from the downstream end of the tube so that the tips of the brush deflect to form a friction fit for imbedding within the tube wall and thereby prevent movement of the brush insert during normal fluid flow in the device.

4 Claims, 3 Drawing Figures

HEAT TRANSFER DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to heat transfer devices and particularly to an augmented heat transfer tube wherein a spiral brush is inserted from the downstream end of the tube so as to form a friction fit therein. As is well known in the art of heat exchangers, the greatest heat exchange is achieved by providing the maximum possible area of material across which the desired heat exchange may take place. Various devices have been employed to increase the material area such as, for example, fins, baffles, or corrugations across which passes a cooling media and between which the heat exchange takes place. These devices were often inserted into a thermally conductive tube so as to contain the media. As is well known in the art, the use of heat exchangers of a tubular configuration is highly advantageous in certain environments wherein the exchanger is so situated that it is immersed within an area of high heat energy such as a nuclear reactor. Heat exchangers of the aforementioned types are relatively complex in their fabrication, inasmuch as the fins or radiating wire must be appropriately attached to the inside of the tube so as to lock the device in place. Other tubular devices utilizing a form of steel wool for an augmented heat dissipating medium are burdensome and time consuming in their fabrication in that the device must be hand packed. Some of the better known prior art devices have also been limited in the amount of heat energy, for example, 8000 watts/inch$^2$ or less, that they can safely handle. Moreover, the requirement for complex fabrication techniques has led to increased manufacturing costs for the known devices.

SUMMARY OF THE INVENTION

Accordingly, it is an object of the present invention to provide a tubular heat exchanger device which is capable of operation in a heat energy environment of approximately 27,000 watts/inch$^2$. Another object of the present invention is to provide a heat exchanger device which is versatile in its use in that the component parts may easily be separated for cleaning or replacement. Yet another object of the present invention is to provide an augmented heat exchanger tube which is simplistic in its fabrication and correspondingly can be manufactured at relatively low cost.

Briefly, these and other objects are accomplished by a heat exchanger having a body of thermally conductive material formed into a tube wherein a thermally conductive spiral brush having a diameter slightly larger than the tube is forced within the tube so as to be centered and form a friction fit therein. The brush, formed of a central stem having bristles thereon, deforms upon being placed in position within the tube so as to provide pressure between the distal ends of the bristles and the inside surface of the tube thereby locking the brush in place. A fluid coolant such as, for example, water is passed through the tube in a direction opposite to that with which the brush was inserted. The fluid is forced to the tube wall due to the brush stem blocking the tube center and also to the free flow area nearer the wall due to the larger spacing between the bristles.

For a better understanding of these and other aspects of the invention, reference may be made to the following detailed description taken in conjunction with the accompanying drawings.

DESCRIPTION OF THE PREFERRED EMBODIMENT

Figure 1:
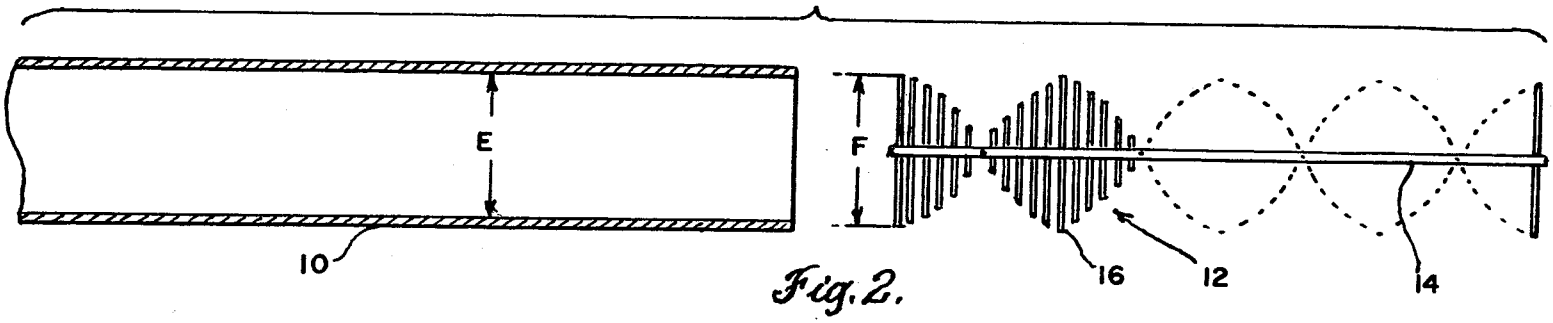
FIG. 1 is a drawing of a heat exchanger tube and spiral brush that is used within the present invention.

Referring now to FIG. 1 there is shown a tube 10 of thermally conductive material. As is well known in the art, the tube material may comprise, for example, copper, aluminum, or steel. In order to better explain the invention, certain dimensions are applied to tube 10 although these dimensions are given by way of example only and it is clearly not intended that the invention be restricted to these sole dimensions. For example, the tube 10 has an inside diameter E of 0.21 inches. A brush 12 is formed from a twisted stem 14 and a plurality of bristles 16 configured in a continuous spiral about the stem 14. The brush 12 is conventional in its fabrication and may be conveniently made, for example, from stainless steel. The stem, for example, may utilize four twisted #20 wires made of 302 stainless steel. The bristles 16, for example, may be made from 0.003 inch diameter 302 stainless steel wire and are positioned in progressive fashion both angularly and axially about the stem 14 to form a spiral.

Figure 2:
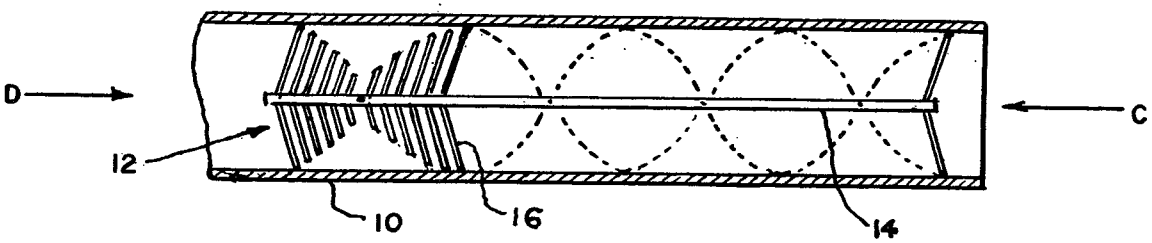
FIG. 2 is a drawing of the present invention showing the spiral brush of FIG. 1 firmly fixed within the tube of FIG. 1.

The operation of the invention will now be described with reference to FIGS. 2 and 3 of the drawings. In FIG. 2 of the drawings, the brush 12 is shown firmly fixed within the tube 10. It is highly desirable that the stem 14 of the brush 12 be maintained in coaxial alignment with the center of the tube 10. As will be obvious to those skilled in the art, an appropriate tool may be conveniently made so as to align the stem 14 with the center of the tube 10 and thereby minimize any deformation of the stem 14 during the insertion process. The brush 12 is inserted into the tube 10 in a direction C. Note that as the brush 12 is fixed within the tube 10, the bristles 16 have deflected to form a friction fit within the inner diameter of the tube 10. This deformation is due to the slightly oversize diameter of the brush 12 with respect to the inner diameter of the tube 10. Accordingly, the bristles 16 effectively embed within the wall of the tube 10 thereby locking the brush 12 into position within the tube 10. As is obvious to those skilled in the art, the pressure required to be exerted upon the brush 12 to move it in direction C will be substantially less than some other pressure required to move the brush in the opposite direction D. In fact, as pressure is applied in direction D, the ends of the bristles 16 are forced even harder against the inside wall of the tube 10 thereby increasing the friction even more between the brush 12 and the tube 10. This increased frictional effect occurring with the application of pressure in direction D will be used to great advantage as will later be explained in the operation of the invention.

Referring again to FIG. 2, the brush 12 fixed within the tube 10 provides augmentation for heat transfer by acting as a flow turbulance promoter and, through thermal contact of the bristles 16 with the inner wall of the tube 10, to a lesser degree serves as an inner extension of the tube 10. In addition, the brush 12 provides a highly desirable flow pattern to a fluid coolant within the tube because the stem 14 blocks the center region of the tube 10 thereby forcing the fluid nearer to the tube wall through the resultant annulis between the stem 14 and the tube 10. Due to the angular arrangement of the bristles 16, the free flow area near the stem 14 is smaller than the free flow area near the wall of the tube 10. As a result, the fluid flow resistance across the annulis is highest near the stem and lowest near the wall of the tube 10. Consequently, most of the fluid will flow near the wall of the tube 10 where the heat is transferred and effectively tubulated by the wire bristles 16. The degree of the heat transfer can be adjusted for any particular application by inserting different types of brushes. In the present embodiment, a spiral brush 12 is described, however, other designs obvious to those skilled in may be readily utilized. The brush and tube dimensions described in the present embodiment provide a porosity of approximately 80%. That is, for a given length of tube and brush, the brush when inserted occupies approximately 20% of the total volume within the tube. Obviously, one of the considerations that must be given to the design of any heat exchange device is the pressure drop across the device. Consequently, the inner dimensions of the tube, as well as the size, density and configuration of the brush will have a direct bearing on the pressure drop within the system. As earlier noted, a greater pressure is required in direction D to move the inserted brush than if pressure was applied in direction C. Accordingly, it is desirable that the fluid flow be directed in direction D so as to enhance the frictional effect between the inserted brush 12 and the tube 10.

Figure 3:
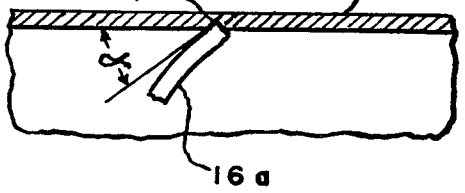
FIG. 3 is a drawing of a magnified portion of the present invention as shown in FIG. 2.

Referring now to FIG. 3, there is shown a drawing of an enlarged portion of the heat exchange device illustrated in FIG. 2. A portion of a single bristle 16*a* is shown with one end firmly embedded at a point P into the wall of the tube 10. The point P of embedment is microscopic in nature, but as FIG. 3 clearly illustrates, the distal end of the bristle 16*a* is firmly fixed by friction alone in contact with the tube 10. As earlier noted, the bristle 16*a* is deflected in the direction D of fluid flow and thereby tangentially forms an approximate acute angle $\alpha$ with the wall of the tube 10. Accordingly, as the fluid forces its way through the brush and over the individual bristles, the bristles are caused to further embed themselves within the tube 10 and offer even greater resistance to the conduction of the fluid. Obviously, the frictional forces created between the brush bristles 16 and the tube 10 must be equal to or greater than the total impinging forces generated by the fluid flow through the tube in order for the brush to remain fixed within the tube.

The present invention may be adapted for use with heat exchange tubes having a multiplicity of curves or other irregularities by simply inserting a plurality of brush sections each having a convenient length. Moreover, an isolated hot spot along a heat exchange tube can be easily alleviated by insertion of an appropriate length brush in the pertinent area. Since the brush is only a friction fit within the tube, it is easily removed for cleaning or replacement. In addition, other factors such as pressure drop and porosity can be easily varied to meet changing needs with different fluids or pressures.

Thus it may be seen that there has been provided a novel heat exchange device capable of operation within relatively high heat environments and that may be simply fabricated and is versatile in its operation.

Obviously, many modifications and variations of the invention are possible in light of the above teachings. For example, if it is desirable to increase the frictional fit of the brush within the tube the brush may be simply enlarged diameter-wise to provide a tighter fit. It is therefore to be understood that within the scope of the appended claims the invention may be practiced otherwise than as specifically described.

What is claimed is:

1. A heat transfer device, comprising, in combination:
   a thermally conductive tube having a predetermined inside radius and adapted to receive a fluid flow in one direction; and
   a thermally conductive brush frictionally and thermally fixed in coaxial alignment within said tube including a stem and a plurality of bristles radially mounted about said stem, each of said bristles having a radial length slightly greater than said radius of said tube and deflected in said one direction from said stem and having the distal ends of said bristles frictionally embed the inner surface of said tube;
   whereby the frictional force fixing said brush within said tube is equal and opposite to the total force of the fluid against said brush.

2. A heat transfer device according to claim 1 wherein each of said bristles are of predetermined rigidity to resist deformation by the force of said fluid flow.

3. A heat transfer device according to claim 2 wherein said bristles form an acute angle with the inner surface of said tube at the distal ends.

4. A heat transfer device according to claim 3 wherein said plurality of bristles are axially displaced along said stem to form a spiral therewith.

* * * * *